US007118096B2

(12) United States Patent
Petrozziello

(10) Patent No.: US 7,118,096 B2
(45) Date of Patent: Oct. 10, 2006

(54) PROTECTIVE GUARD FOR A FENCE

(76) Inventor: Louis J. Petrozziello, 3 Forest Dr. North, Short Hills, NJ (US) 07078

( * ) Notice: Subject to any disclaimer, the term of this patent is extended or adjusted under 35 U.S.C. 154(b) by 0 days.

(21) Appl. No.: 10/816,706

(22) Filed: Apr. 2, 2004

(65) Prior Publication Data

US 2005/0218392 A1 Oct. 6, 2005

(51) Int. Cl.
*E04H 17/02* (2006.01)

(52) U.S. Cl. ..... 256/32; 256/1; 256/19; 256/33

(58) Field of Classification Search ..... 256/1, 256/19, 32, 33; 5/663
See application file for complete search history.

(56) References Cited

U.S. PATENT DOCUMENTS

| | | | | |
|---|---|---|---|---|
| 399,617 | A | 3/1889 | Ihnen | |
| 1,636,189 | A | 7/1927 | Louden | |
| 3,395,489 | A | 8/1968 | Banse | |
| 3,622,125 | A | 11/1971 | Powell | |
| 3,648,981 | A | 3/1972 | Allen | |
| 3,707,276 | A | 12/1972 | Francis et al. | |
| 3,933,311 | A | 1/1976 | Lemelson | |
| 3,960,367 | A | 6/1976 | Rogers | |
| 4,022,452 | A | 5/1977 | Dupre | |
| 4,071,223 | A | 1/1978 | Demarest | |
| 4,220,316 | A * | 9/1980 | Naka et al. | 256/59 |
| 4,349,989 | A | 9/1982 | Snider, Jr. | |
| 4,497,472 | A | 2/1985 | Johnson | |
| 4,508,320 | A | 4/1985 | Hegarty | |
| 4,523,745 | A * | 6/1985 | Killman et al. | 256/1 |
| 4,548,388 | A | 10/1985 | Cobler | |
| 4,702,034 | A | 10/1987 | Ferguson et al. | |
| 4,723,758 | A | 2/1988 | Gehrig | |
| 4,767,419 | A * | 8/1988 | Fattore | 5/659 |
| 4,789,138 | A | 12/1988 | Acton | |
| 4,899,991 | A | 2/1990 | Brunkan | |
| 4,907,783 | A | 3/1990 | Fisk et al. | |
| 5,141,207 | A * | 8/1992 | Meglino et al. | 256/33 |
| 5,178,369 | A | 1/1993 | Syx | |

(Continued)

FOREIGN PATENT DOCUMENTS

| | | |
|---|---|---|
| GB | 2273524 | 6/1994 |

*Primary Examiner*—Daniel P. Stodola
*Assistant Examiner*—Michael P. Ferguson
(74) *Attorney, Agent, or Firm*—Lerner, David, Littenberg, Krumholz & Mentlik, LLP

(57) ABSTRACT

A combination includes a fence and a protective guard. The fence has vertical posts with upper ends and at least one top support bar extending between the vertical posts. The protective guard includes a tubular member having first and second ends, an outer surface extending between the first and second ends, an inner surface extending between the first and second ends that defines an interior space, and a slot extending between the inner and outer surfaces and the first and second ends of the tubular member. The tubular member is secured over an upper edge of the fence so that the upper ends of the vertical posts and the at least one top support bar are captured within the interior space of the tubular member. The combination also includes a spacer positioned between the inner surface of the tubular member and the at least one top support bar for supporting the tubular member between the vertical posts, and insulation material disposed in the slot and the interior space of the tubular member for sealing the interior space of the tubular member.

15 Claims, 16 Drawing Sheets

U.S. PATENT DOCUMENTS 5,328,156 A 7/1994 Hoke
5,340,086 A 8/1994 Dorr
5,402,988 A 4/1995 Eisele
5,437,071 A * 8/1995 Feigenbaum ..... 5/663
5,597,262 A 1/1997 Beavers et al.
5,762,444 A 6/1998 Giannelli
5,794,390 A 8/1998 Oliveri et al.
5,829,913 A 11/1998 Puckett
2001/0035523 A1 11/2001 Venegas
2001/0052595 A1 12/2001 Hulett
2004/0012006 A1 1/2004 Petrozziello

* cited by examiner

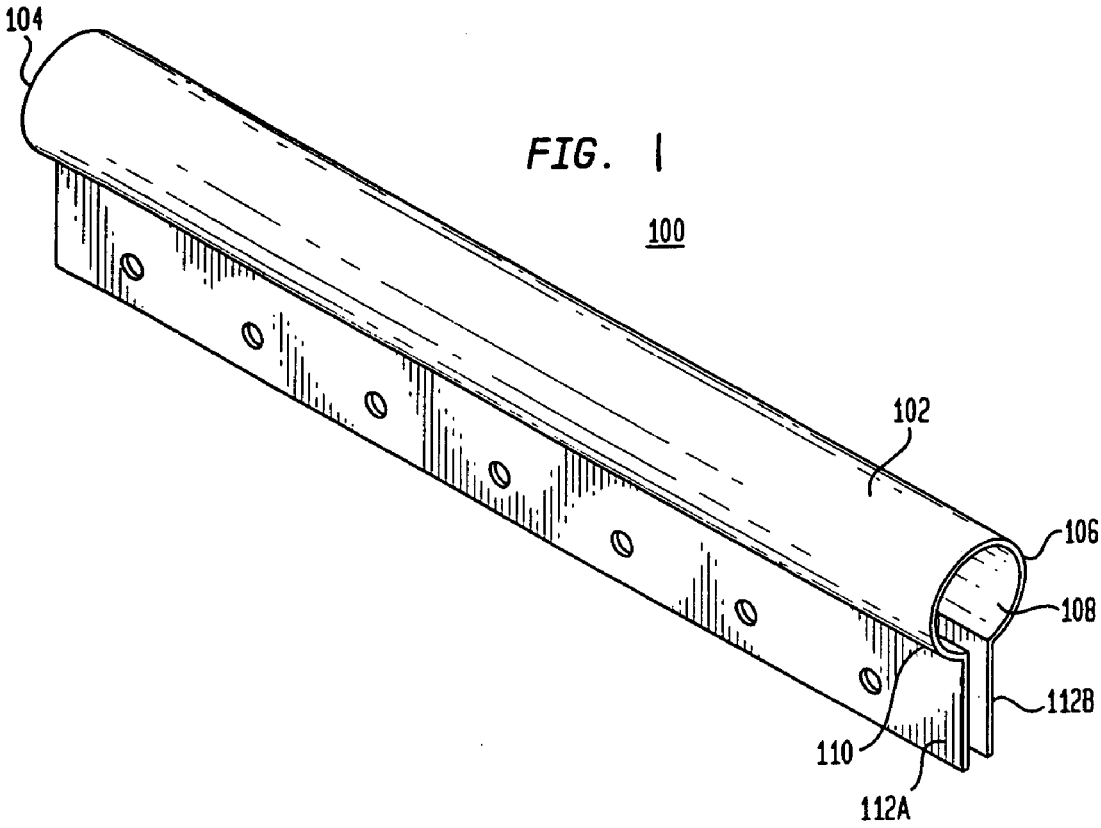
FIG. 1
FIG. 2
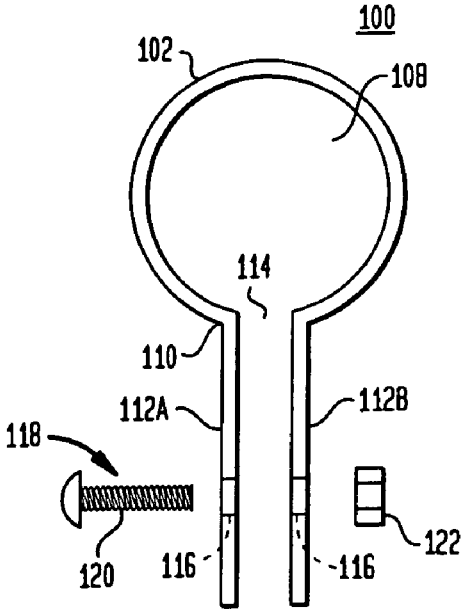
FIG. 3
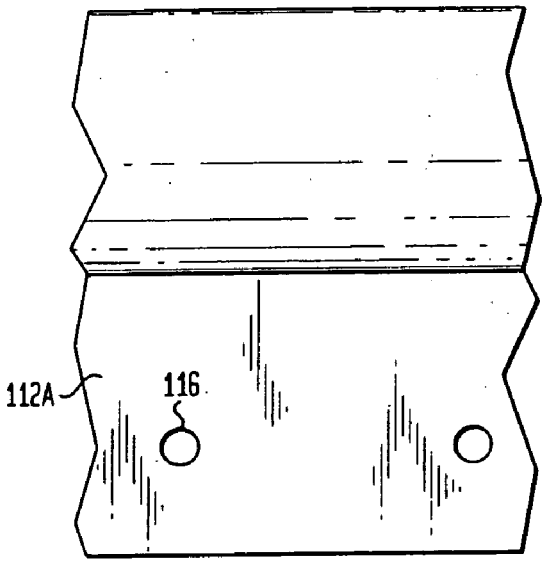

200

300

400

PROTECTIVE GUARD FOR A FENCE

CROSS REFERENCE TO RELATED APPLICATIONS

The present application is related to U.S. patent application Ser. No. 10/199,803, filed Jul. 19, 2002, now U.S. Patent Application Publication No. 2004/0012006, the disclosure of which is hereby incorporated by reference herein.

The above-referenced U.S. Patent Application Publication No. 2004/0012006 discloses a protective guard securable atop a fence to protect individuals from contacting the sharp edges of the fence. The protective guard has a rounded tubular member that defines an interior space that is designed to surround and capture the upper ends of vertical posts, the top support bars extending between the vertical posts and the upper edge of the wire mesh or chain link secured to the top support bars and the vertical posts.

BACKGROUND OF THE INVENTION

The present invention is generally related to fencing and is particularly related to protective guards secured to fences for preventing injuries to individuals contacting the fences.

Most fences have sharp edges, particularly at upper edges of the fences. One type of fence, commonly referred to as a chain-link fence, has many sharp edges created by vertical posts, wire mesh and top support bars. Frequently, and particularly when playing sports, individuals collide with and/or become entangled with chain-link fences, which can cause severe cuts, bruises and bone fractures.

In response to the above-identified problems, protective guards have been positioned atop fences. These prior art protective guards are typically constructed from corrugated tubing made of polymer materials such as polyvinyl chloride. A longitudinal cut is made in the tube and the tube is positioned atop a fence. Unfortunately, a number of problems have been observed when using the prior art protective guards made of corrugated tubing. First, the tubing has a thickness of about 0.08 cm. Thus, the tubing is not sturdy and tends to easily crack when subjected to stress, strain and impact. Furthermore, the corrugated tubing is designed to be used as drainage tubing that is placed underground, not atop a fence. As a result, the corrugated tubing cannot withstand prolonged exposure to weather and sunlight, which results in the tubing become brittle and losing its color (bleaching). Moreover, the relatively thin tubing does not maintain a straight line over the top of the fence but tends to sag, buckle and bend.

The above-referenced '803 application discloses a protective guard securable atop a fence to protect individuals from contacting the sharp edges of the fence. The protective guard has a rounded tubular member that defines an interior space that is designed to surround and capture the upper ends of vertical posts, the top support bars extending between the vertical posts and the upper edge of the wire mesh or chain link secured to the top support bars and the vertical posts.

When the protective guard disclosed in the '803 application has been secured atop fences, it has been observed that insects, such as bees, and small animals, such as birds, may build nests in the interior space of the tubular member. This may create a dangerous situation when an individual contacts the protective guard, e.g. bees from a nest may sting an individual that has contacted the fence.

In view of the above problems, it is clear that there is a need for a protective guard that may be easily and reliably secured to an upper edge of a fence, such as a chain link fence. There is also a need for a protective guard that is rugged and able to withstand prolonged exposure to sunlight and weather. There is also a need for a protective guard that prevents animals and insects from gaining access to the interior space of a tubular portion of the guard. Moreover, there is a need for a protective guard for a fence that maintains an aesthetically-pleasing, straight-line appearance when positioned atop a fence.

SUMMARY OF THE INVENTION

In certain preferred embodiments, a protective guard securable over an upper edge of a fence includes an elongated member having first and second ends, an outer surface, an inner surface defining an interior space and an elongated opening extending between the inner and outer surfaces and the first and second ends thereof. In certain preferred embodiments, the elongated member is an elongated tube that is substantially cylindrical in shape and is adapted for fitting over the components that are typically present at the top of a fence, i.e., fence post, fence post cap, top support bar, wire mesh, slats, etc. The protective guard also preferably includes first and second attachment flanges integrally formed with the elongated member on opposite sides of the elongated opening, the first and second attachment flanges being adapted for engaging opposite sides of the fence when the protective guard is secured atop the fence. The protective guard also preferably includes one securing element in contact with the opposing first and second attachment flanges for securing the attachment flanges together on opposite sides of the fence. The at least one securing element preferably passes through the fence.

In certain preferred embodiments, the at least one securing element includes a plurality of securing elements and the first and second attachment flanges include a series of first and second openings, respectively, that are in substantial alignment with one another. To secure the protective guard to the fence, the plurality of securing elements are desirably passed through the first and second opening of the first and second attachment flanges.

In one particular preferred embodiment, the securing elements are passed through first openings in the first attachment flange, through a portion of the fence, and then through the second openings of the second attachment flange. As a result, the fence is sandwiched or clamped between the opposing first and second attachment flanges. The plurality of securing elements prevent the guard from being removed from its attachment to the fence.

In certain preferred embodiments, the attachment flanges are adapted for flexing away from one another so that the upper edge of the fence is passable between the first and second attachment flanges, through the elongated opening of the elongated member and into the interior space of the elongated member for positioning the protective guard over the upper edge of the fence. In certain embodiments, the fence is preferably a chain link fence including a top support bar and wire mesh secured to the top support bar. When the protective guard is secured over the chain link fence, the first and second attachment flanges are secured over opposite sides of the wire mesh. In other preferred embodiments, the fence is made of wood, such as wooden slats having upper ends whereby the protective guard is secured over at least one of the wooden slats. The elongated member may be designed to fit snuggly over the top of the fence.

The protective guard is preferably flexible so that it may conform to the shape of an upper edge of a fence. For example, the fence may be an outfield fence of a baseball field having a curved contour, and the protective guard is able to flex so as to curve and follow the contour of the outfield fence. The first and second attachment flanges integrally formed to the elongated member are also preferably flexible for conforming to the contour of the fence. In certain preferred embodiments, the elongated member and first and second attachment flanges integrally connected therewith are made of plastic. In other preferred embodiments, the elongated member and first and second attachment flanges integrally connected therewith are made of extruded plastic. The protective guard may be made of colored plastic. In certain preferred embodiments, the protective guard may be made of multiple colors that alternate. For example, the protective guard may alternate between a white plastic color and a blue plastic color. The colors may be repeatedly alternated along the length thereof to give the protective guard a striped appearance. The protective guard may also have horizontal stripes molded therein or text printed thereon.

During installation atop a fence, the opposing attachment flanges are preferably flexed away from one another so that an upper edge of the fence may pass between the opposing attachment flanges, past the elongated opening in the elongated member, and abut against the inner surface of the elongated member. The one or more securing elements may then engage the first and second attachment flanges and pass through a portion of the fence for reliably securing the protective guard to the upper edge of the fence. Although the present invention is not limited by any particular theory of operation, it is believed that providing opposing attachment flanges integrally connected with the protective guard makes for a more reliable attachment between the protective guard and the fence. The use of attachment flanges and securing elements passing through the attachment flanges prevents the protective guard from being jarred loose, blown away, or stolen by vandals. As a result, greater assurances exist that the protective guard will be in place when needed.

In one preferred embodiment, the protective guard is secured over the top of an outfield fence on a baseball field. Typically, such fences are made of wood or are chain link fences. The upper edges of such fences may be jagged, sharp or rough and may result in serious injury when a baseball player pursues a ball in the area of the fence. In numerous instances, baseball players have collided with the fence, particularly the upper edge of the fence, causing broken bones, broken teeth, concussions, etc. Providing a protective guard, including a elongated member over an upper edge of a baseball outfield fence, will soften any collision between a player and the fence, thereby minimizing injuries.

In still other preferred embodiments of the present invention, a protective guard securable over an upper edge of a fence includes an elongated, flexible member having first and second ends, an outer surface, an inner surface defining an interior space and an elongated opening extending between the inner and outer surfaces and the first and second ends. The protective guard also desirably includes first and second attachment flanges integrally formed with the elongated tube on opposite sides of the elongated opening, wherein the first and second attachment flanges are adapted for engaging opposite sides of the fence when the protective guard is secured atop the fence. The protective guard also desirably includes at least one securing element engaging the first and second attachment flanges and passing through the fence for securing the protective guard to the fence.

In yet another preferred embodiment of the present invention, a combination includes a fence and a protective guard. The fence has vertical posts with upper ends and at least one top support bar extending between the vertical posts. In certain preferred embodiments, the fence is a chain link fence. The combination desirably includes a tubular member having first and second ends, an outer surface extending between the first and second ends, an inner surface extending between the first and second ends that defines an interior space, and a slot extending between the inner and outer surfaces and the first and second ends of the tubular member. The tubular member is preferably secured over an upper edge of the fence so that the upper ends of the vertical posts and the at least one top support bar are captured within the interior space of the tubular member. The combination also desirably includes a spacer positioned between the inner surface of the tubular member and the at least one top support bar for supporting the tubular member between the vertical posts, and insulation material disposed in the slot and the interior space of the tubular member for sealing the interior space of the tubular member.

In certain preferred embodiments, the upper ends of the vertical posts extend above the at least one top support bar by a vertical distance, with the spacer having a height that is substantially equal to the vertical distance. The spacer supports the tubular member to prevent sagging of the tubular member between the vertical posts. The spacer desirably has an upper end in contact with the interior surface of the tubular member and a lower end in contact with the at least one top support bar.

In preferred embodiments, the protective guard is made of polypropylene, which more effectively withstands exposure to weather and sunlight than tubing made of polyvinyl chloride. As is well-known to those skilled in the art, PVC corrugated tubing will bleach and crack when exposed to weather and sunlight, which makes it unsuitable for long-term use atop a fence.

The tubular member preferably has a thickness of about 0.10–0.40 cm and more preferably about 0.15–0.35 cm. Thus, due to its thickness, the tubular member of the present invention is much sturdier than the corrugated tubing used in prior art protective guards. As a result, the protective guard of the present invention is better able to maintain a straight-line between vertical posts and to stand up to impact without cracking.

In certain preferred embodiments, the insulation material includes at least one resilient strip positioned within the slot of the tubular member. When the guard is placed atop a fence, the resilient strip is able to conform to the shape of the fence and still provide a seal at the slot. For example, when a chain link fence is used the resilient strip conforms to the plurality of links of the wire mesh to provide a seal along the slot formed in the tubular member. The insulation material may also be wrapped around the vertical posts to provide a seal between the posts and the interior space of the protective guard. The insulation material may include a ring of resilient material positioned around a vertical post or one or more resilient strips wrapped around the vertical posts. The insulation material may also include caps positioned within openings at the first and second ends of the tubular member. The caps serve to block the openings at the first and second ends to prevent insects and animals from building nests within the interior space. The caps may also serve to prevent trash and refuse from being placed within the interior space. The caps may be made of any material including polymer materials, metal, wood and foam. It is contemplated that the insulation material may include any object or material that seals orifices present in the protective guard to prevent access into the interior space of the tubular member or a section of the interior space of the tubular member.

In certain preferred embodiments, the combination may also include first and second attachment flanges extending from the outer surface of the tubular member on opposite sides of the slot, with the attachment flanges being positioned on opposite sides of the fence when the protective guard is secured over the fence. At least one securing element, such as a nut and screw, may be in contact with the attachment flanges for securing the attachment flanges together on opposite sides of the fence. The securing element may include any object that holds two items together such as a clip, cable tie or tape.

In certain preferred embodiments, an end of a tubular member has a reduced diameter that is adapted to slide within an opening at an end of an adjacent protective guard. As a result, adjacent protective guards may be assembled together in a telescope-like connection. Such a connection creates a sleek transition zone between a first protective guard and a second protective guard. In other preferred embodiments, notches may be formed in the attachment flanges for avoiding overlapping of attachment flanges when the reduced diameter end is inserted into the opening of an adjacent protective guard.

In still other preferred embodiments of the present invention, a combination includes a fence and a protective guard. The fence has vertical posts with upper ends and at least one top support bar extending between the vertical posts. The protective guard desirably includes a tubular member having first and second ends, an outer surface extending between the first and second ends, an inner surface defining an interior space and a slot extending between the inner and outer surfaces and the first and second ends of the tubular member. The tubular member is secured over an upper edge of the fence so that the upper ends of the vertical posts and the at least one top support bar are captured within the interior space of the tubular member. The combination also preferably includes a spacer positioned within the interior space of the tubular member, the spacer being in contact with the inner surface of the tubular member for supporting the tubular member between the vertical posts so as to prevent the tubular member from sagging between the vertical posts.

In another preferred embodiment of the present invention, a combination includes a fence and a protective guard, the fence having vertical posts with upper ends and at least one top support bar extending between the vertical posts. The combination also desirably includes a tubular member having first and second ends, an outer surface extending between the first and second ends, an inner surface extending between the first and second ends, the inner surface defining an interior space, and a slot extending between the inner and outer surfaces and the first and second ends of the tubular member. The tubular member is secured over an upper edge of the fence so that upper ends of the vertical posts and the at least one top support bar are captured within the interior space of the tubular member. An insulation material is desirably disposed in the slot and the interior space of the tubular member for sealing the interior space of the tubular member.

These and other preferred embodiments of the present invention will be discussed in more detail below.

BRIEF DESCRIPTION OF THE DRAWINGS

FIG. 1 shows a perspective view of a protective guard securable atop a fence, in accordance with certain preferred embodiments of the present invention.

FIG. 2 shows a cross-sectional view of the protective guard of FIG. 1 including a securing element for securing the protective guard to a fence.

FIG. 3 shows a fragmentary view of the protective guard shown in FIGS. 1 and 2.

FIGS. 22A and 22B show a method of forming a corner turn in a protective guard, in accordance with still other preferred embodiments of the present invention.

DETAILED DESCRIPTION

Figure 4:
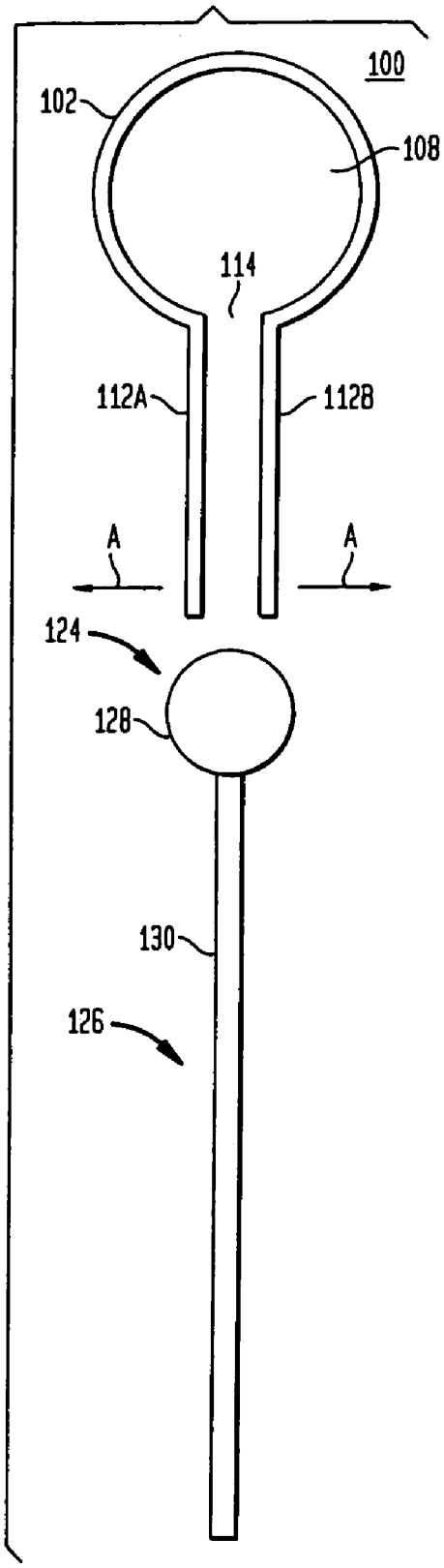
FIG. 4 shows the protective guard of FIGS. 1 and 2 being secured atop a fence.

FIG. 1 shows a protective guard 100 for a fence, in accordance with certain preferred embodiments of the present invention. The protective guard 100 includes an elongated tube 102 having a first end 104 and a second end 106 remote therefrom. The tube is preferably cylindrical in shape and defines an interior space 108 of the tube that extends between the first and second ends 104, 106 thereof. The protective guard also includes opposing attachment flanges 112A, 112B that are integrally formed with and extend from a lower end 110 of tube 102. The opposing attachment flanges 112A, 112B are preferably made of the same material that comprises the elongated tube 102.

FIG. 2 shows a cross-sectional view of the protective guard 100 of the present invention including elongated flexible tube 102 and integrally formed opposing attachment flanges 112A and 112B. The lower end 110 of tube 102 has an opening 114 formed therein so that the opposing attachment flanges 112A, 112B may be flexed away from one another for allowing an upper edge of a fence to be inserted into internal space 108 of tube 102.

Referring to FIG. 3, the opposing attachment flanges 112A, 112B include a series of aligned openings 116 extending along the length of the protective guard and through the attachment flanges so that a securing element 118, such as a screw 120 and a nut 122, may be used to secure the attachment flanges together.

FIGS. 4 show the protective guard 100 of the present invention being secured atop an upper edge 124 of a fence 126, the fence including top support rail 128 and wire mesh section 130. During installation of the protective guard 100 atop a fence, the lower ends of the attachment flanges 112A, 112B may be moved in opposite directions designated by arrows A—A. As a result, the top support rail 128 may pass between the attachment flanges 112A, 112B, through opening 114 and into interior space 108 of tube 102.

Figure 5:
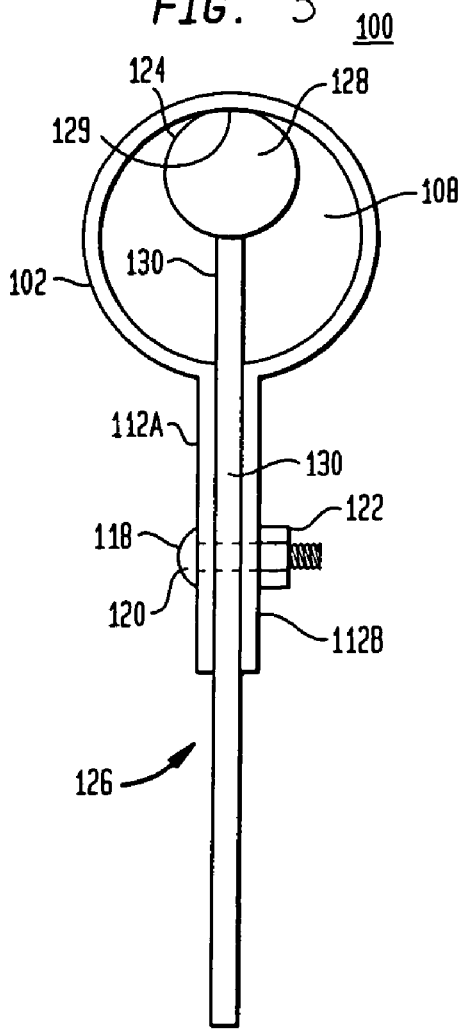
FIG. 5 shows the protective guard of FIGS. 1 and 2 after the protective guard has been secured atop a fence and held in place using a securing element.

FIG. 5 shows the protective guard 100 of the present invention secured atop upper edge 124 of fence 126. After the protective guard has been assembled to the fence 126, the top support rail 128 preferably rests against an interior top surface 129 of tube 102 and a portion of wire mesh 130 lies within interior space 108 of tube 102. The securing element 118 is then passed through an opening in first attachment flange 112A, through wire mesh 130, and through an opening in second attachment flange 112B. A nut 122 is preferably threaded onto an end of screw 120 for clamping the wire mesh 130 between the opposing attachment flanges 112A, 112B. In other preferred embodiments, any type of securing element may be used for holding the opposing attachment flanges together, including clips, ties, bolts, clamps, etc.

Although the present invention is not limited by any particular theory of operation, it is believed that providing integrally formed attachment flanges 112A, 112B at a lower end of a flexible tube 102 enables the protective guard 100 to be reliably secured to an upper edge of a fence, such as a chain link fence. As a result, the protective guard will not be blown off, fall off, be jarred off, or stolen by vandals, thereby insuring that the protective guard will always be in place when needed to protect individuals who collide with the fence.

Figure 6:
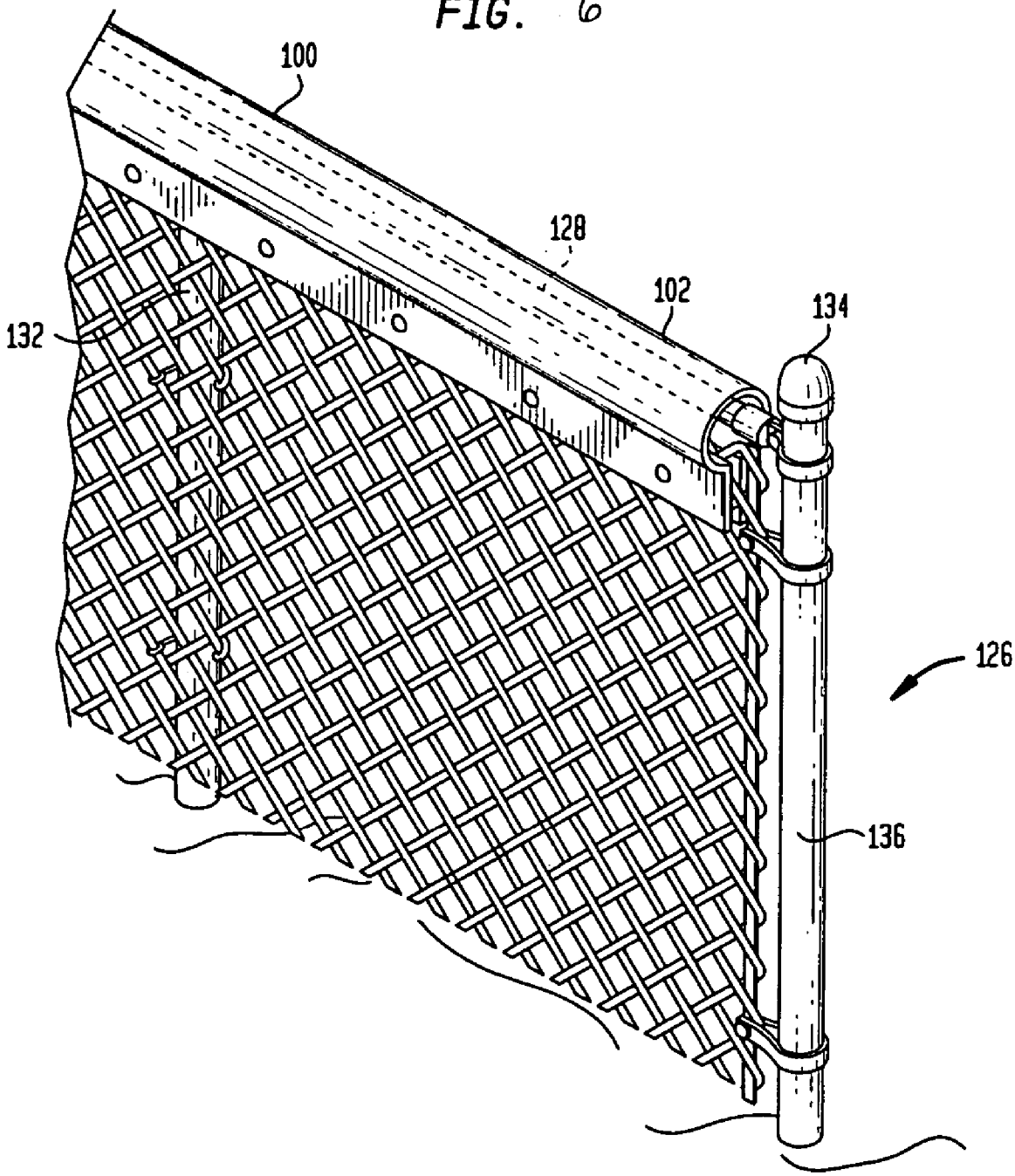
FIG. 6 shows a perspective view of a fence having the protective guard of FIGS. 1 and 2 secured atop the fence and held in place using securing elements, in accordance with certain preferred embodiments of the present invention.

FIG. 6 shows a perspective view of the protective guard 100 secured atop fence 126. The protective guard extends over top support bar 128 and an upper end of intermediate post 132. In certain preferred embodiments, the protective guard 100 may be modified to enlarge the tube portion 102 thereof so that the tube completely surrounds any component present at the upper edge of the fence, such as an enlarged cap atop an end post.

Figure 7:
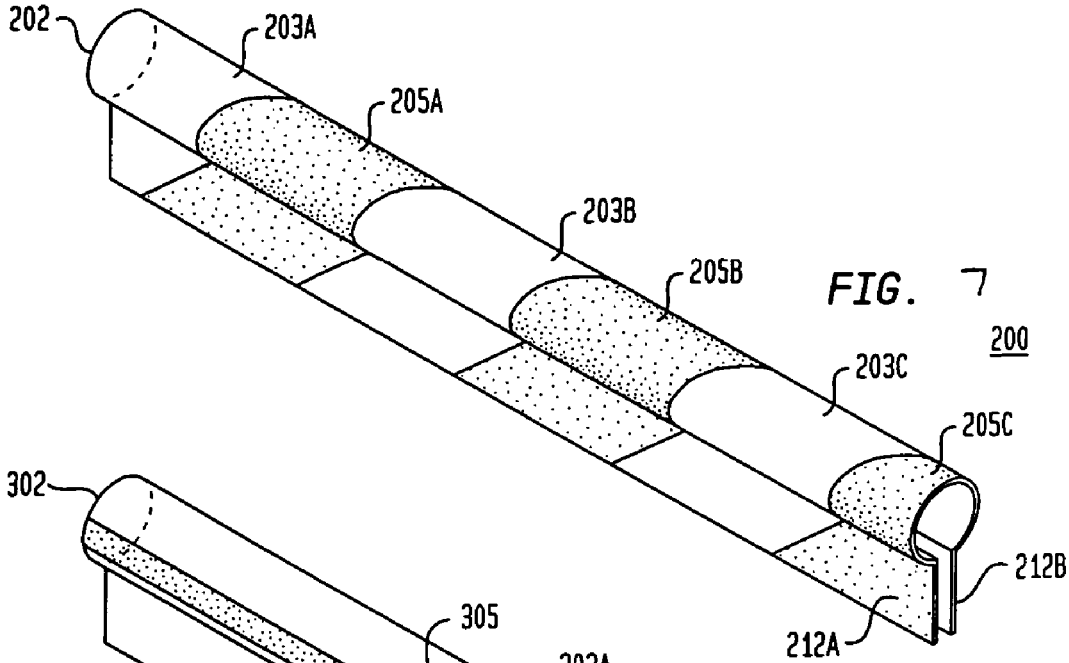
FIG. 7 shows a perspective view of a protective guard, in accordance with other preferred embodiments of the present invention.

FIG. 7 shows a protective guard, in accordance with other preferred embodiments of the present invention. The protective guard includes an elongated tube 202 and opposing first and second attachment flanges 212A and 212B. The protective guard 200 is preferably made of an extruded material, such as extruded plastic, whereby the colors of the plastic are alternated to give the protective guard a striped appearance. In the particular embodiment shown in FIG. 7, the elongated tube and first and second attachment flanges including alternating first sections 203A, 203B, 203C and second sections 205A, 205B, 205C that are made of different colors. As a result, the protective guard has a striped appearance.

Figure 8:
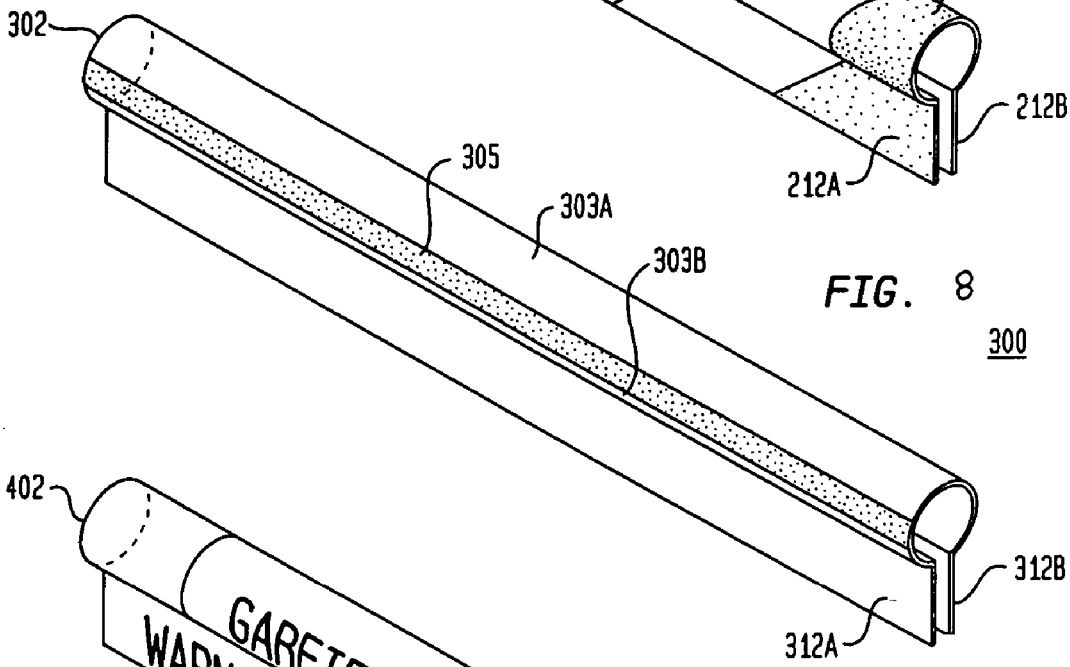
FIG. 8 shows a perspective view of a protective guard, in accordance with another preferred embodiment of the present invention.

FIG. 8 shows a protective guard 300 including an elongated tube 302 and opposing first and second attachment flanges 312A, 312B. The protective guard 300 has one or more stripes 305 that extend horizontally along the length of the protective guard. The horizontal stripe 305 is preferably of a color that is different than the alternating first sections 303A and 303B. As a result, the protective guard 300 has a striped appearance, whereby the stripes extend in a horizontal direction. The protective guard may also have a plurality of different colored stripes.

Figure 9:
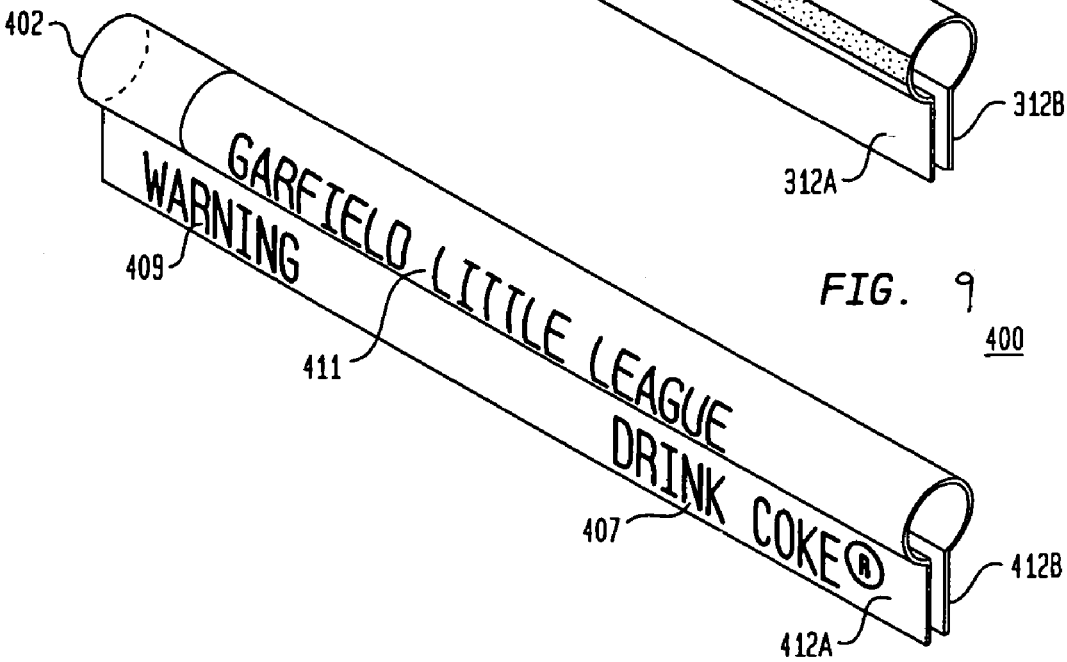
FIG. 9 shows a perspective view of a protective guard, in accordance with still another preferred embodiment of the present invention.

In the embodiment shown in FIG. 9, the protective guard 400 includes elongated tube 402 and opposing first and second attachment flanges 412A and 412B. The protective guard is extruded, and preferably comprises a polymer material. A message 405 may be screened anywhere on the protective guard 400. Preferred messages may include an advertisement 407, a warning 409, the name of a league 411, the name of a school, the name of a team, etc.

Figure 10:
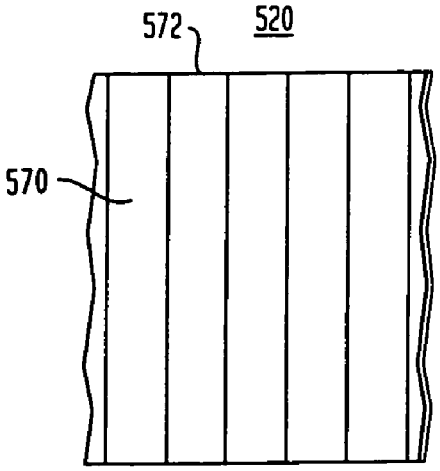
FIG. 10 shows a fence including wood slats.
Figure 11:
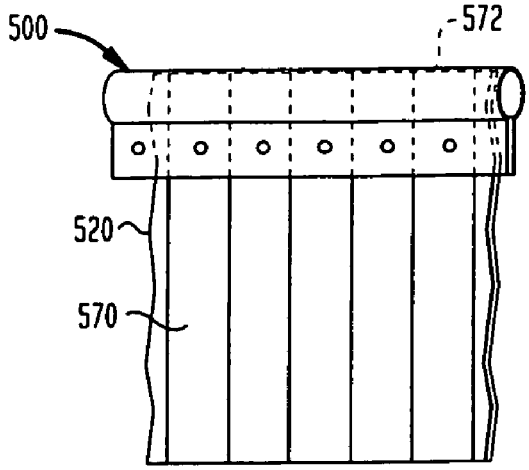
FIG. 11 shows the protective guard of FIG. 1 secured atop the fence of FIG. 10.

FIGS. 10 and 11 show the protective guard of the present invention secured atop a wood fence. Referring to FIG. 10, fence 520 is made of wooden slats 570 having upper ends 572. Referring to FIG. 11, the protective guard shown and described above in FIG. 1 is secured over the upper end 572 of one or more slats 570 for protecting the upper edge of fence 520.

Figure 12:
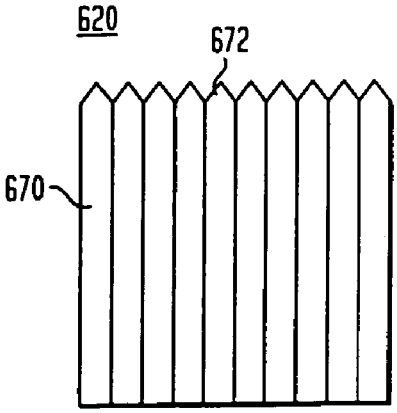
FIG. 12 shows a front elevational view of a fence.
Figure 13A:
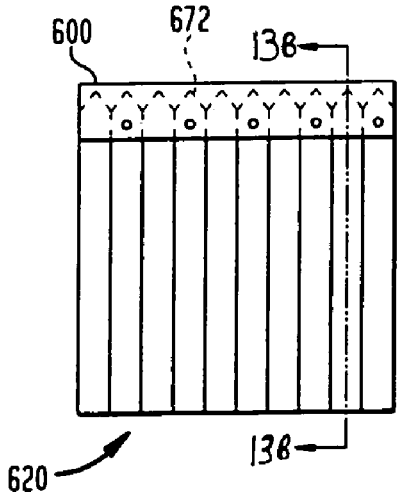
FIGS. 13A shows the fence of FIG. 12 covered by a protective guard, in accordance with still another preferred embodiment of the present invention.
Figure 13B:
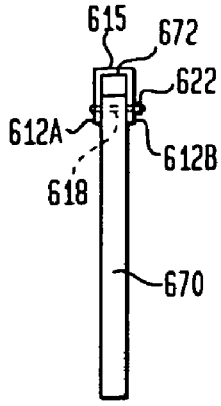
FIG. 13B shows the fence and protective guard of FIG. 13A taken along line 13B—13B of FIG. 13A.

FIG. 12 shows a fence 620 including slats 670 having upper ends 672 that are pointed. Referring to FIGS. 13A and 13B, a protective guard 600 is secured over the upper end 672 of the fence 620 for covering the pointed end of the fence. The protective guard has opposing attachment flanges 612A and 612B that extend on opposite sides of slat 670. A securing element 618 is passed through an opening in first attachment flange 612A, through slat 670 and through a second opening in second attachment flange 612B. A nut 622 is preferably threaded onto an end of securing element 618 for securing the slat between the opposing attachment flanges 612A, 612B. In other preferred embodiments, any kind of securing element may be used for holding the opposing attachment flanges 612A, 612B together, such as clips, ties, bolts, clamps, etc. Such securing element may pass over the top of the protective guard 600.

Referring to FIGS. 13A and 13B, in certain preferred embodiments, the elongated tube at the top of the protective guard is not substantially cylindrical in shape, but is squared off to provide a snugger fit between the protective guard and the fence. In a particular preferred embodiment shown in FIG. 13B, the protective guard is an elongated member having a substantially flat top 615, whereby the opposing attachment flanges 612A, 612B extend downwardly from the substantially flat top 615. As a result, the opposing flanges extend in a direction substantially perpendicular to the plane of the substantially flat top. In other preferred embodiments, the top of the protective guard may be slightly curved to pass over the upper ends 672 of the slats 670.

Figure 14B:
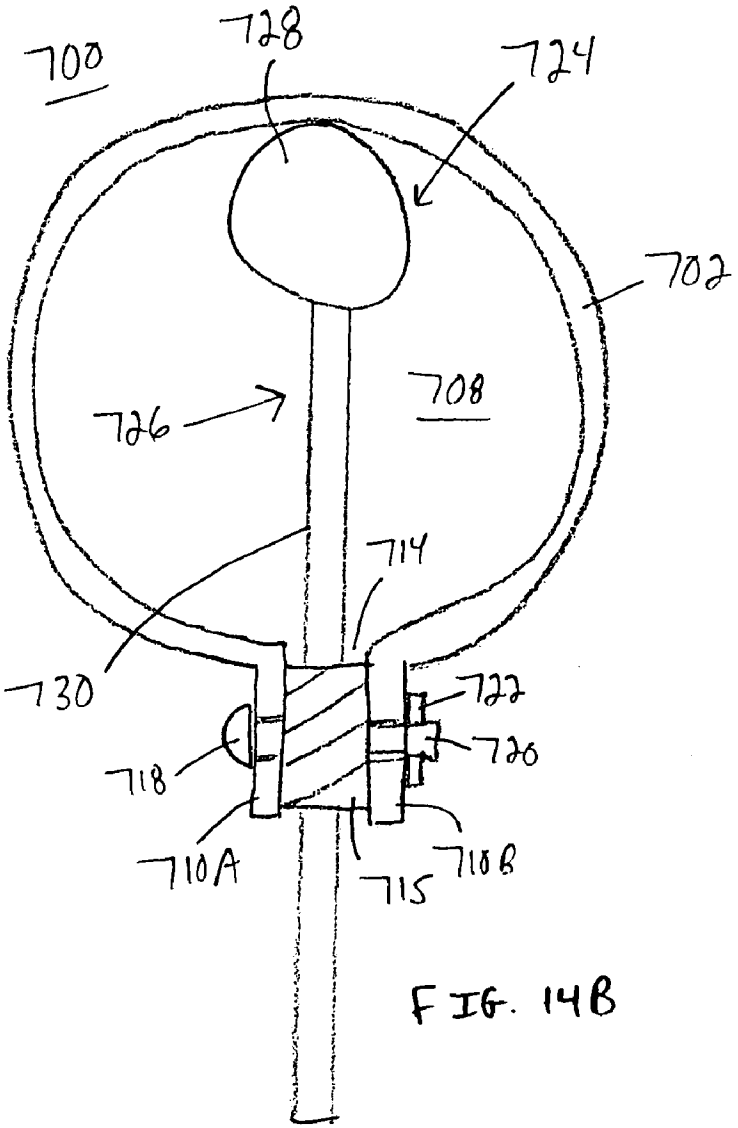
FIG. 14B shows the protective guard of FIG. 14A secured atop a fence.
Figure 14A:
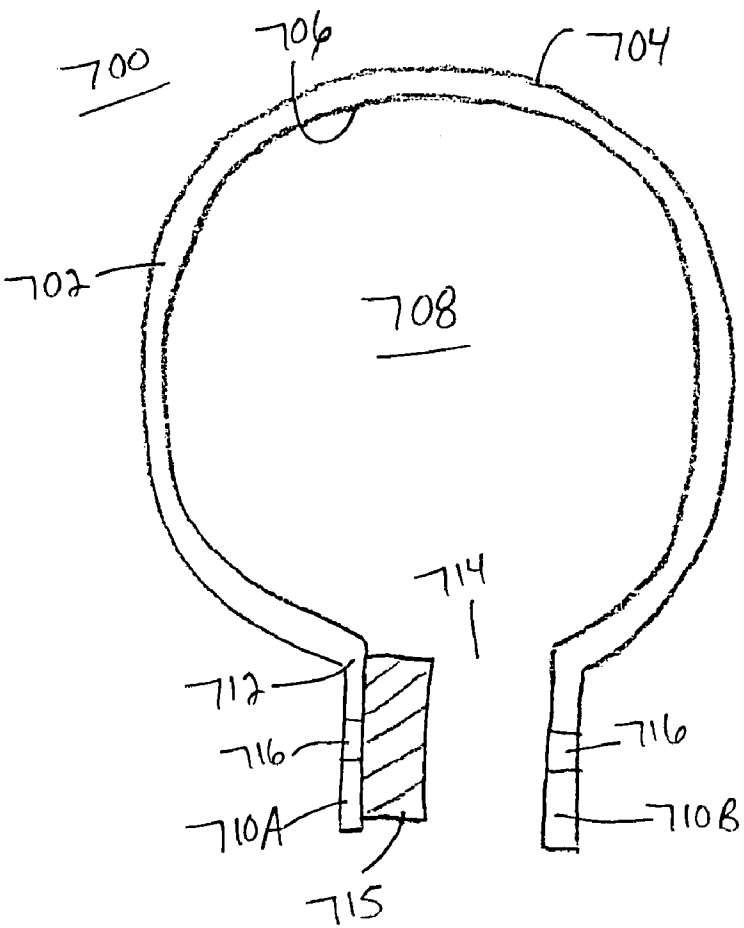
FIG. 14A shows a cross-sectional view of a protective guard for a fence, in accordance with other preferred embodiments of the present invention.

FIG. 14A shows a protective guard 700 including an elongated tubular member 702 having an exterior surface 704 and an inner surface 706 that defines an interior space 708 of tubular member 702. The protective guard 700 also includes opposing attachment flanges 710*a*, 710*b* that may be integrally formed with and extend from a lower end 712 of tubular member 702. In certain preferred embodiments, the protective guard 700 is preferably made from an extruded polymer material such as polypropylene that has been chemically treated to withstand weather and UV light. The protective guard includes an insulating material 715 such as a resilient strip that is secured to first attachment flange 710*a*. In other preferred embodiments, the insulating element 715 may be secured to the second attachment flange 710*b* or may be positioned between the two attachment flanges 710*a*, 710*b*.

The lower end 712 of tubular member 702 has an opening or slot 714 formed therein, so that the opposing attachment flanges 710*a*, 710*b* may be flexed away from one another for allowing an upper edge of a fence including at least one top support bar and upper ends of vertical posts to be inserted into the interior space 708 of tubular member 702. The opposing attachment flanges 710*a*, 710*b* may include aligned openings 716 extending therethrough.

Referring to FIG. 14B, the protective guard 700 is secured atop an upper portion 724 of a fence 726 including a top support rail 728 and a wire mesh section 730. During installation of the protective guard 700 atop fence 726, the attachment flanges 710*a*, 710*b* may be moved away from one another to allow the top support rail 728 and vertical posts (not shown) to pass therethrough. A securing element 718 is passed through aligned openings 716 of attachment flanges 710*a*, 710*b* for securing the attachment flanges together. As nut 722 is tightened on screw 720, the attachment flanges are preferably forced toward one another for clamping around the wire mesh section 730 of fence 726. As the flanges clamp around the wire mesh, the opposing attachment flanges 710*a*, 710*b* preferably compress the insulation material 715 therebetween so as to form a seal at the slot 714 of tubular member 702. Although the present invention is not limited by any particular theory of operation, it is believed that providing an insulating material 715 between the attachment flanges 710*a*, 710*b* effectively seals the slot 714 to close a passageway into the interior space 708 of the tubular member 702. This seal 715 prevents small animals and insects from entering the interior space 708 of the tubular member. For example, absence of the insulating element 715 would enable bees to build nests within the interior space 708 of the tubular member. In addition, birds may also build nests within the interior space 708. Such occurrences may events would reduce the function of the protective guard, which is to minimize injuries to individuals passing by or contacting a fence.

Figure 15B:
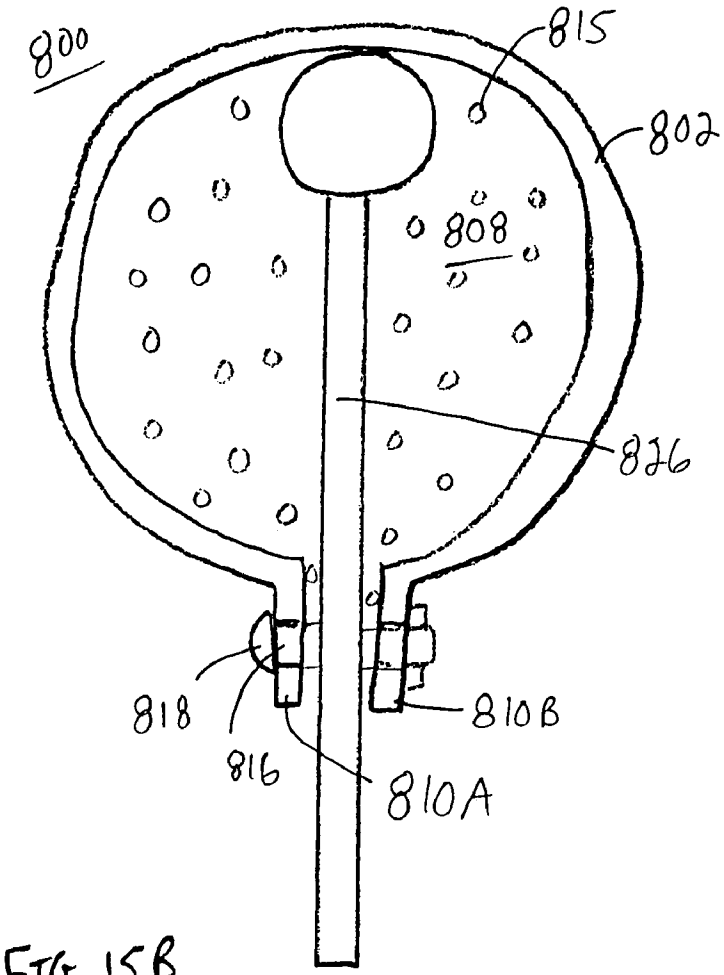
FIGS. 15A–15C show a method of securing a protective guard atop a fence and providing an insulating filler material inside the protective guard, in accordance with other preferred embodiments of the present invention.
Figure 15A:
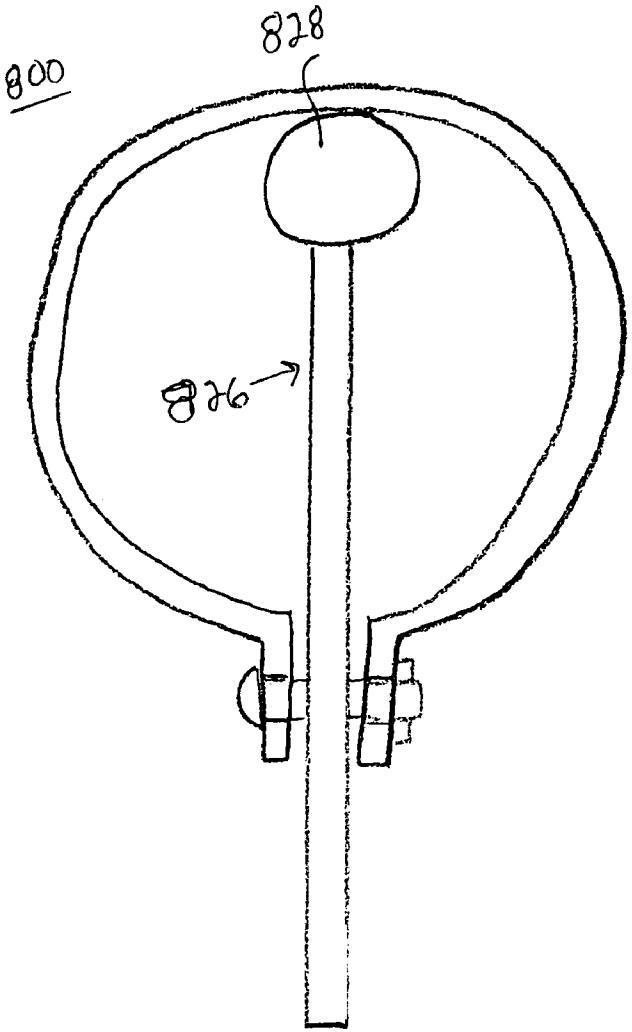
Figure 15C:
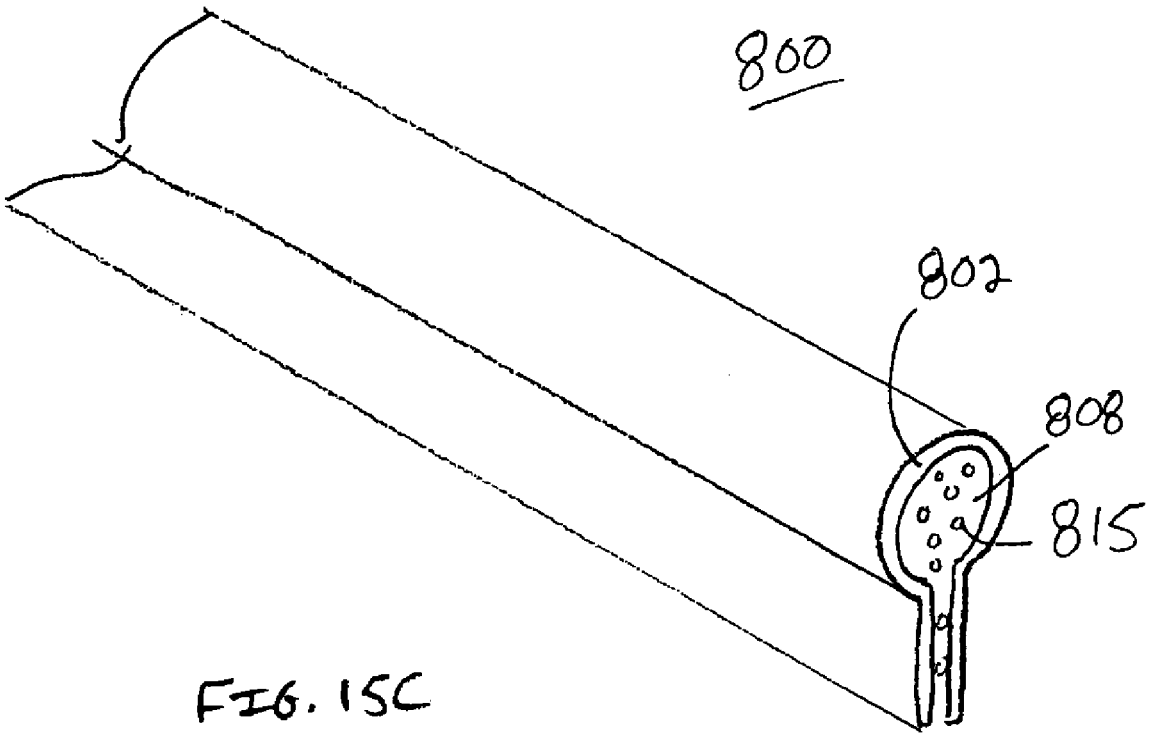

Referring to FIGS. 15A and 15B, in other preferred embodiments of the present invention, a protective guard 800 is secured atop a fence 826 having a top support rail 828 and vertical posts (not shown). Either before or after a securing element 818 is passed through the respective openings 816 of attachment flanges 810*a*, 810*b* for securing the protective guard 800 to the fence 826, an insulating foam 815 is disposed within the interior space 808 of tubular member 802. The insulating foam may be sprayed into the interior space. The insulating foam 818 preferably fills a substantial portion of the interior space 808 extending between first and second ends (not shown) of the tubular member 802. As described in conjunction with the earlier embodiment shown in FIGS. 14A and 14B, the insulating foam prevents, inter alia, small insects and animals from building nests inside the tubular member. FIG. 15C shows a perspective view of an end of the protective guard 800 including insulating foam disposed within interior space 808 of tubular member 802.

Figure 16A:
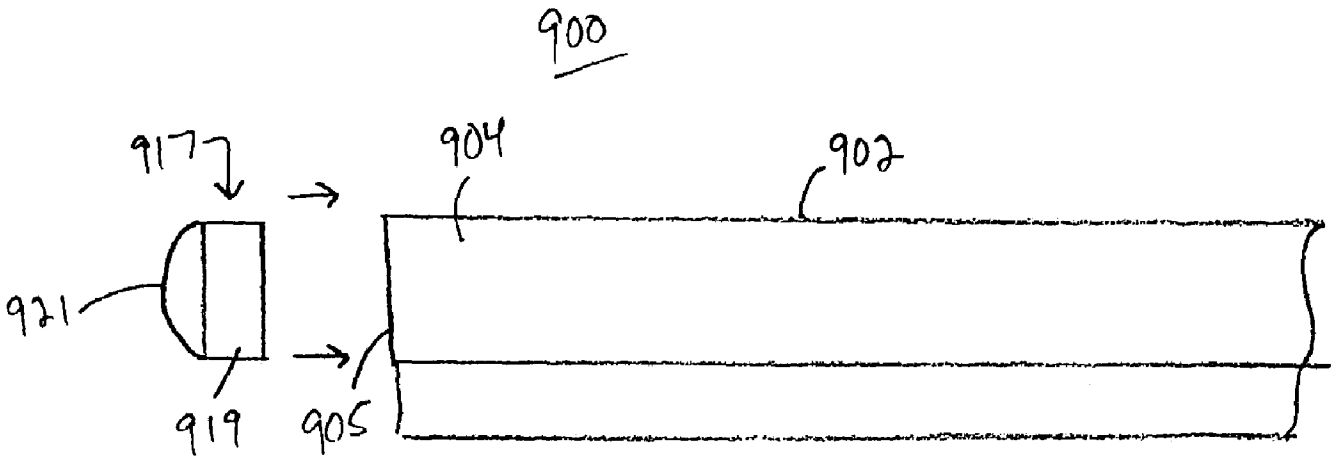
FIGS. 16A and 16B show a method of insulating an open end of a protective guard, in accordance with further preferred embodiments of the present invention.

FIG. 16A shows a protective guard 900 having a first end 904 having an opening 905 and a second end (not shown) remote therefrom. An endcap 917 having a cylindrical base 919 and a rounded nose 921 is insertable into the opening 905 for sealing the first end 904 of tubular member 902. A second endcap may seal a second end of the tubular member. The endcap 917 may be made of any material including polymers, wood, metal and foam.

Figure 16B:
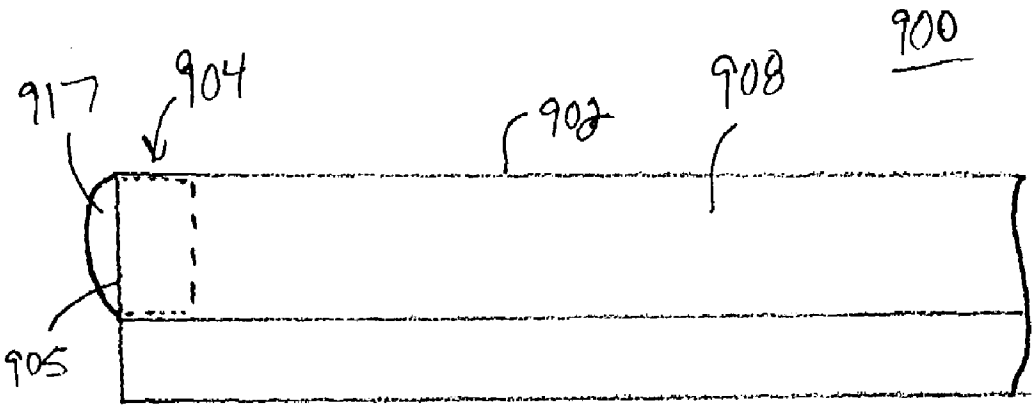

FIG. 16B shows endcap 917 inserted into the first opening 905 at the first end 904 of tubular member 902. The endcap 917 seals the open end of the tubular member 902. The endcap 917 prevents insects and birds from building nests in the interior space 908 of the protective member 900. The endcap 917 also provides a rounded edge at an end of the protective guard so as to minimize risk to passers-by. The endcap 917 may also minimize the likelihood of passers-by inserting refuse or waste material inside the protective guard 900, and limits the amount of moisture that may collect inside the guard. A second endcap may be inserted into an opening at a second end of the protective guard.

Figure 17:
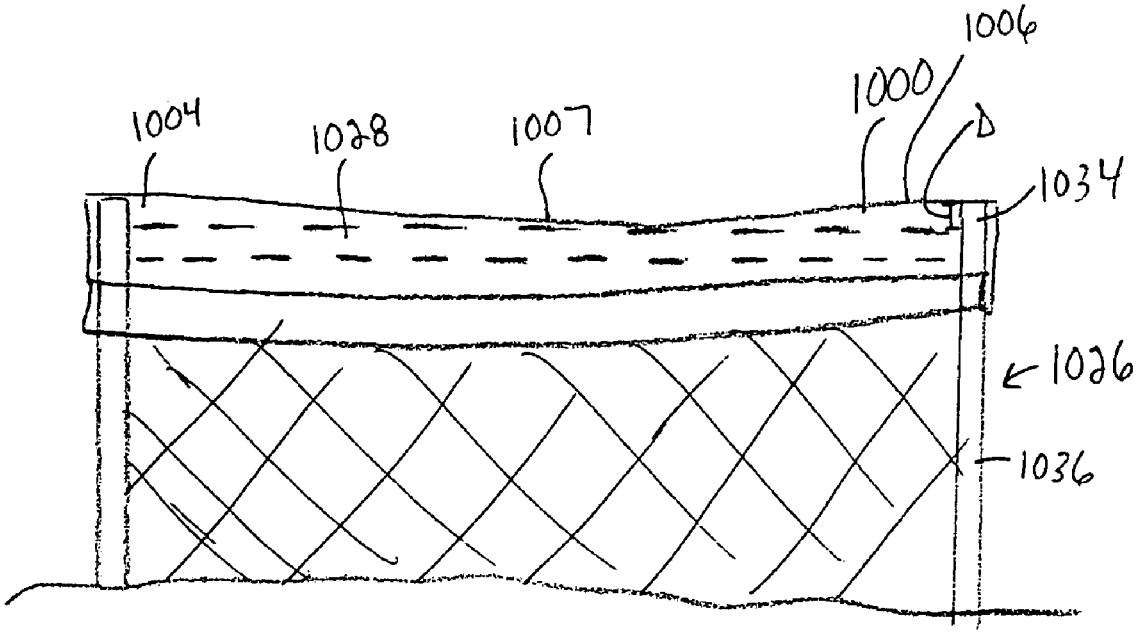
FIG. 17 shows a protective guard secured atop a fence.

FIG. 17 shows a protective guard 1000 secured atop a fence 1026 including vertical posts 1036 having upper ends 1034 and a top support bar 1028 extending between the two vertical posts 1036. The uppermost surface of the vertical post 1036 defines a vertical distance D between top support bar 1028 and the uppermost surface of the vertical post. As a result of the vertical distance D between the upper ends of the vertical posts and the top support bar, the protective guard 1000 is only supported in a vertical direction at its first and second ends 1004, 1006. Thus, an intermediate region 1007 of protective guard 1000 tends to sag until the interior surface engages top support bar 1028.

Figure 18A:
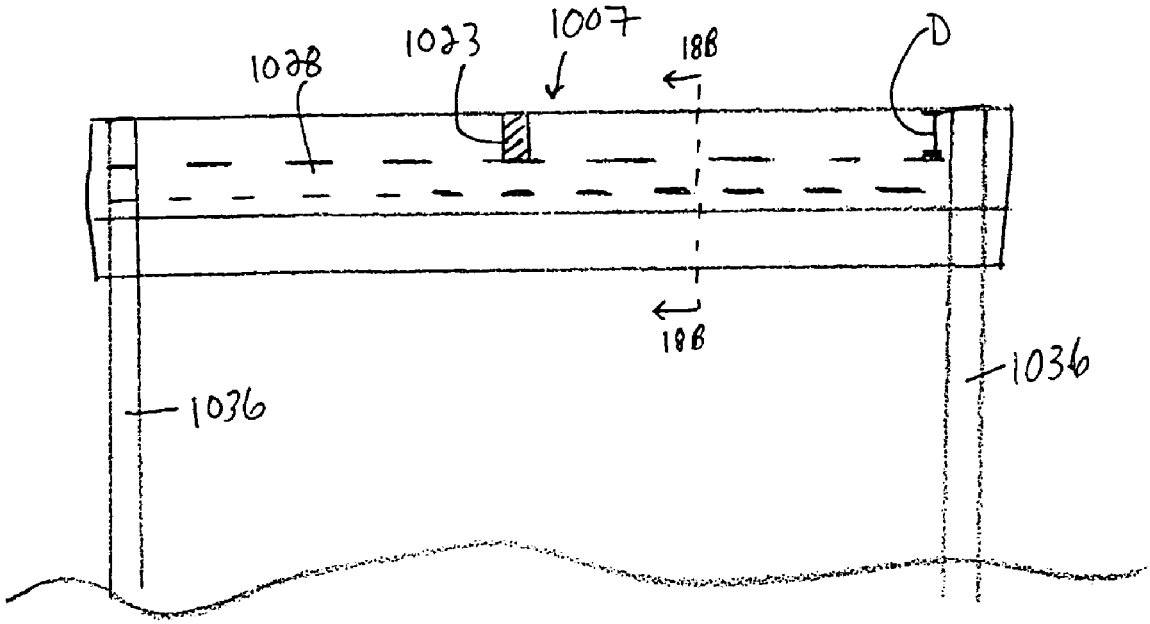
FIG. 18A shows a protective guard including a spacer in contact with a fence, in accordance with other preferred embodiments of the present invention.
Figure 18B:
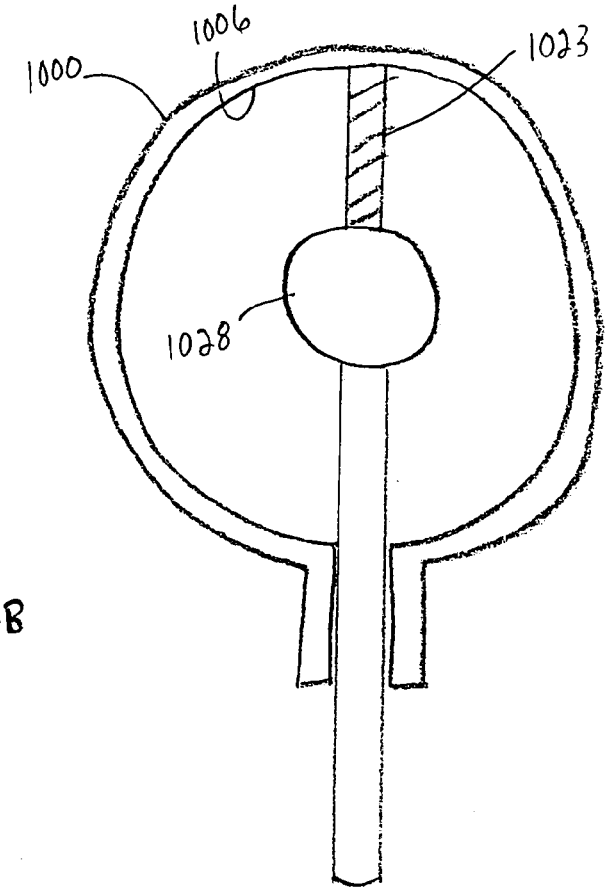
FIG. 18B shows a cross-sectional view of FIG. 18A taken along line 18B—18B thereof.

Referring to FIG. 18A, in order to prevent intermediate region 1007 from sagging, a spacer element 1023 is positioned between inner surface 1006 and top support bar 1028. Although not limited by any particular theory of operation, it is believed that spacer 1023 prevents the intermediate region 1007 of protective guard 1000 from sagging between adjacent vertical posts (not shown). The height of the spacer 1023 preferably matches the vertical distance D between the uppermost ends of vertical posts and the top support bar 1028.

Figure 19:
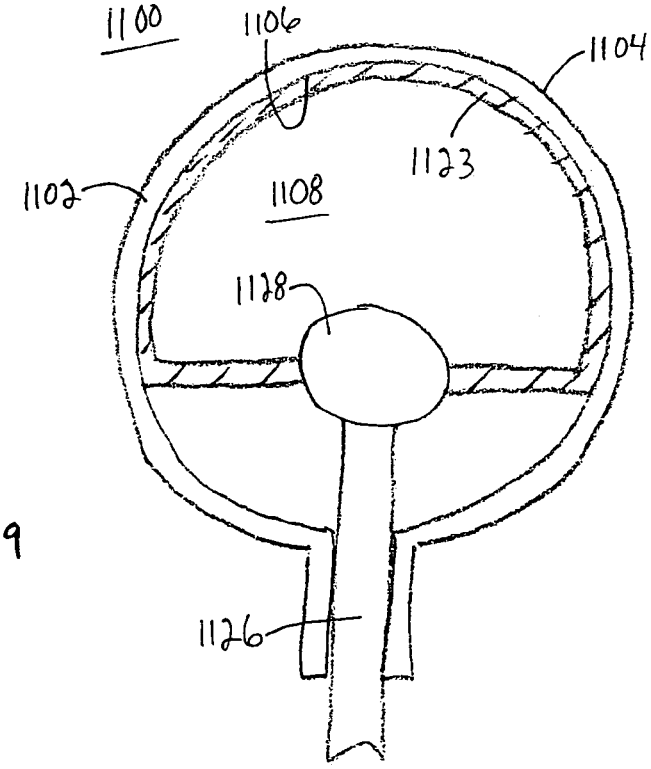
FIG. 19 shows a cross-sectional view of a protective guard including a spacer, in accordance with further preferred embodiments of the present invention.

FIG. 19 shows a protective guard 110 including an inner surface 1106 and an exterior surface 1104 remote therefrom.

The protective guard 1100 is secured atop a fence 1126 including a top support bar 1128. A spacer element 1123 having an at least partially ring-like configuration is positioned within the interior space 1108 of protective guard 1100. The spacer element 1123 is in contact with the inner surface 1106 of protective guard 1100 and the top support bar 1128 of fence 1126. The spacer element 1123 prevents an intermediate portion of the protective guard between adjacent vertical posts from sagging as shown in FIG. 17. In other preferred embodiments, the spacer element may not engage the top support rail 1128 but may engage another portion of the fence. In still other preferred embodiments, the spacer element may not contact the fence at all, but may merely engage the inner surface of tubular member 1102. The spacer may be a stiffening element, such as a sleeve, in contact with the tubular member. Although not limited by any particular theory of operation, it is believed that providing a spacer element at an intermediate region of the protective guard will prevent the intermediate region from sagging, which will both diminish the effectiveness of the protective guard and reduce its aesthetic appearance.

Figures 20A, 20B:
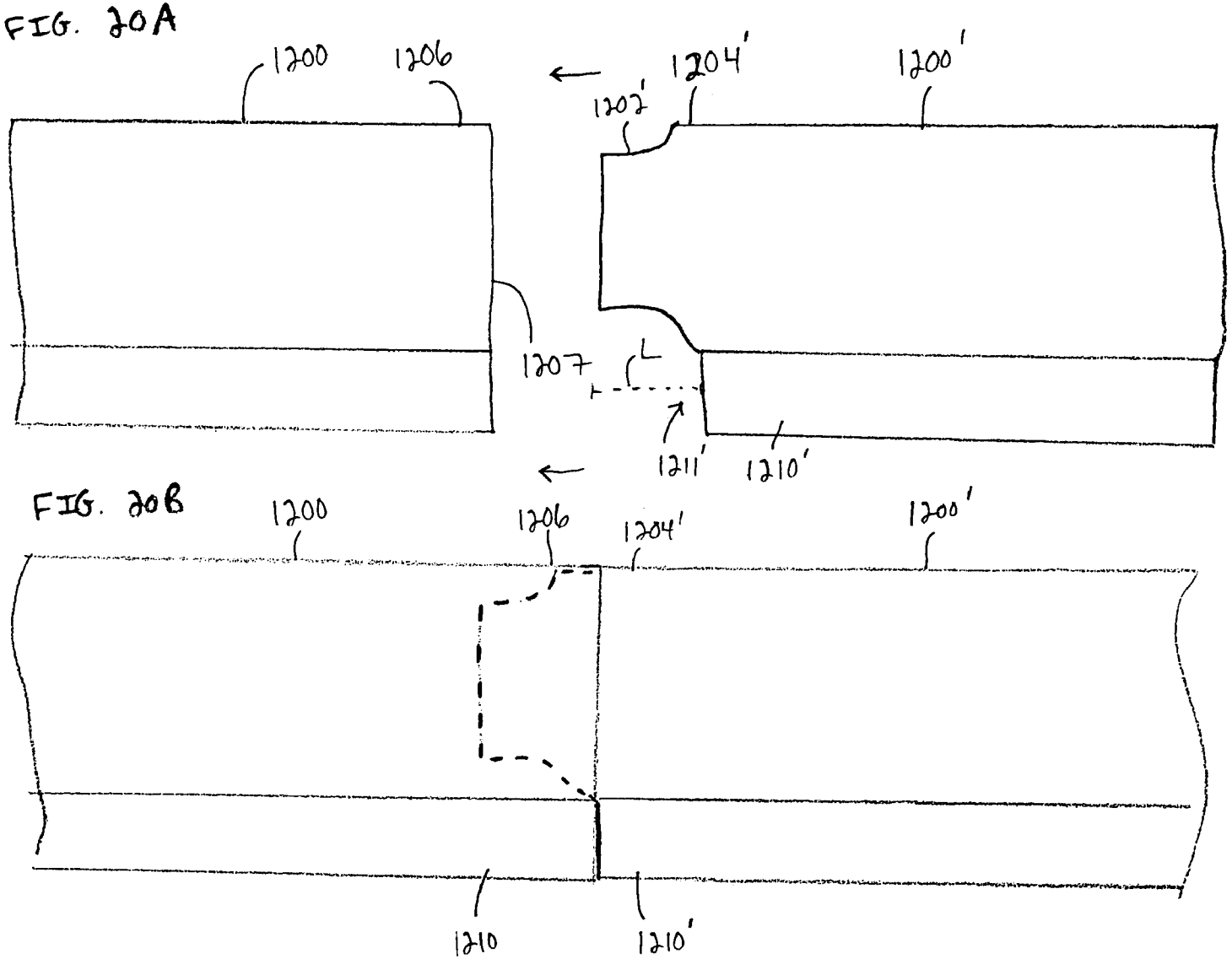
FIG. 20A shows a protective guard having a tubular member with a reduced diameter and a notch formed in the attachment flanges thereof, in accordance with other preferred embodiments of the present invention.
FIG. 20B shows the protective guard of FIG. 20A assembled with an opening of an adjacent protective guard, in accordance with further preferred embodiments of the present invention.

FIGS. 20A and 20B show a method of assembling two protective guards. Referring to FIG. 20A, a first protective guard 1200 has a second end 1206 with an opening 1207. Next to the first protective guard 1200 is a second protective guard 1200' having a first end 1204 with the tubular member 1202 having a reduced diameter and the attachment flange 1210' having a notch 1211 formed therein. In other words, the attachment flange 1210' does not extend all the way to the end of the second protective guard 1200', but is spaced from the first end by a distance designated L.

Referring to FIG. 20B, the first and second protective guards 1200, 1200' are assembled together by inserting the first end 1204' of second protective guard 1200' into the opening at the second end 1206 of first protective guard 1200. The reduced diameter 1202' of the second protective guard 1200' enables the first end 1204' to telescopically fit within the second end 1206 of first protective guard 1200. Furthermore, the notched attachment flanges 1210' enable a continuous, non-overlapping line to be formed with the attachment flanges 1210, 1210'.

Figure 21B:
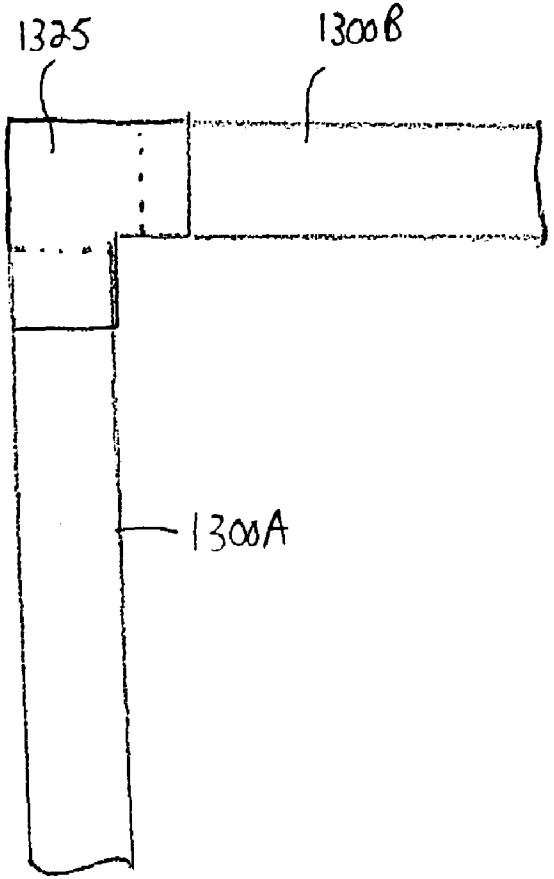
FIGS. 21A and 21B show a method of assembling two protective guards with one another using a coupler, in accordance with certain preferred embodiments of the present invention.
Figure 21A:
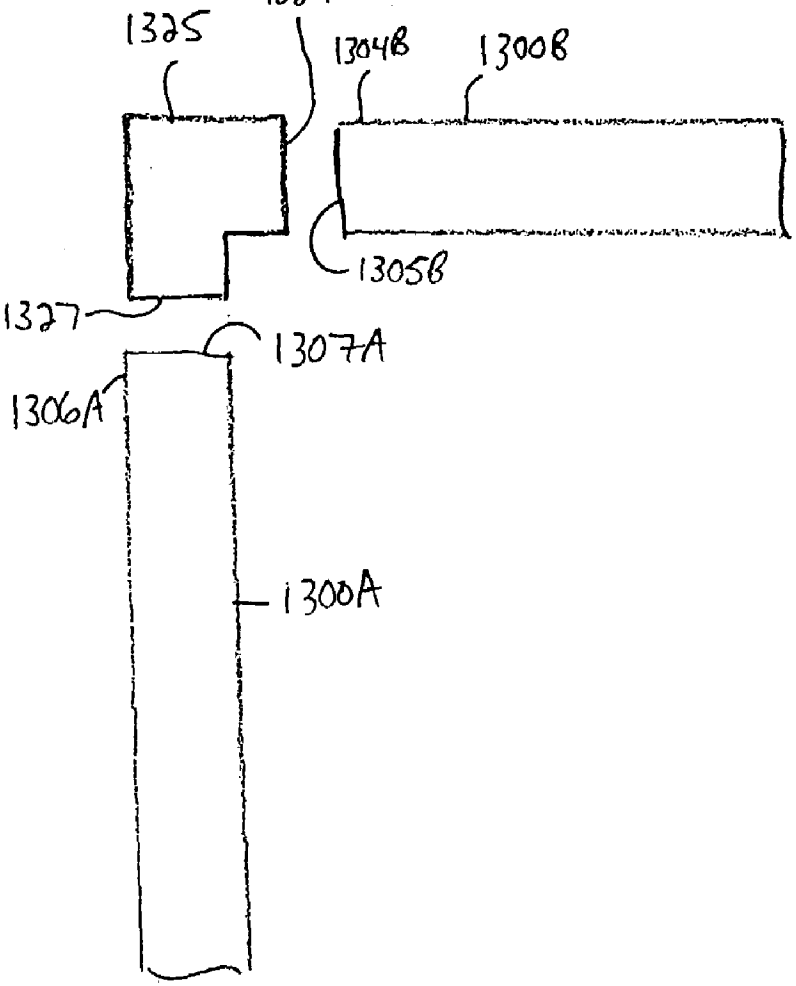
Figure 27A:
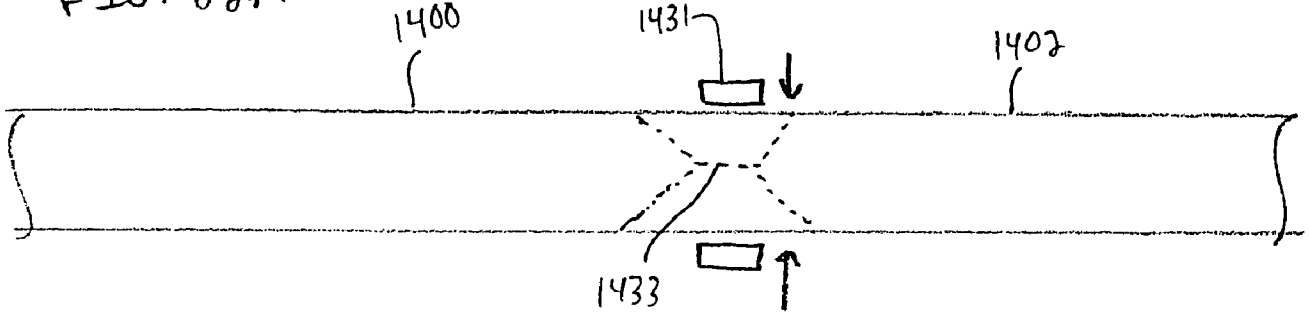
Figure 27B:
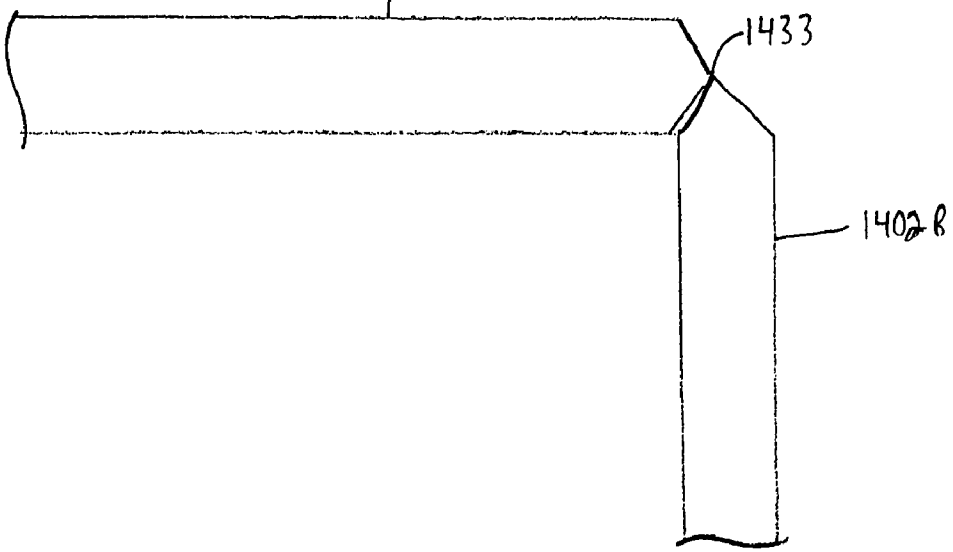

FIGS. 21A and 21B show a method of assembling two protective guards with one another at an angle. Referring to FIG. 21A, first protective guard 1300A has a second end 1306A having an opening 1307A and second protective guard 1300B has a second end 1304B with an opening 1305B formed therein. A coupler 1325 has a first opening 1327 for receiving first protective guard 1300A and a second opening 1329 for receiving second protective guard 1300B.

FIG. 21B shows the first and second protective guards 1300A, 1300B after being assembled with coupling element 1325. The coupling element 1325 in FIG. 21B forms a 90° angle, however, other angles between 0° and 90° may be used.

Referring to FIG. 22A, a protective guard 1400 having tubular member 1402 may be crimped using a crimping element 1431 so as to form a crimped portion 1433. Referring to FIG. 22B, the crimped portion 1433 may be bent to form a protective guard having a first section 1402*a* extending in a first axial direction and a second section 1402*b* extending in a second axial direction. The crimped portion 1433 enables the first and second sections 1402*a*, 1402*b* to be positioned at any angle relative to one another between 0°–90°.

Figure 23:
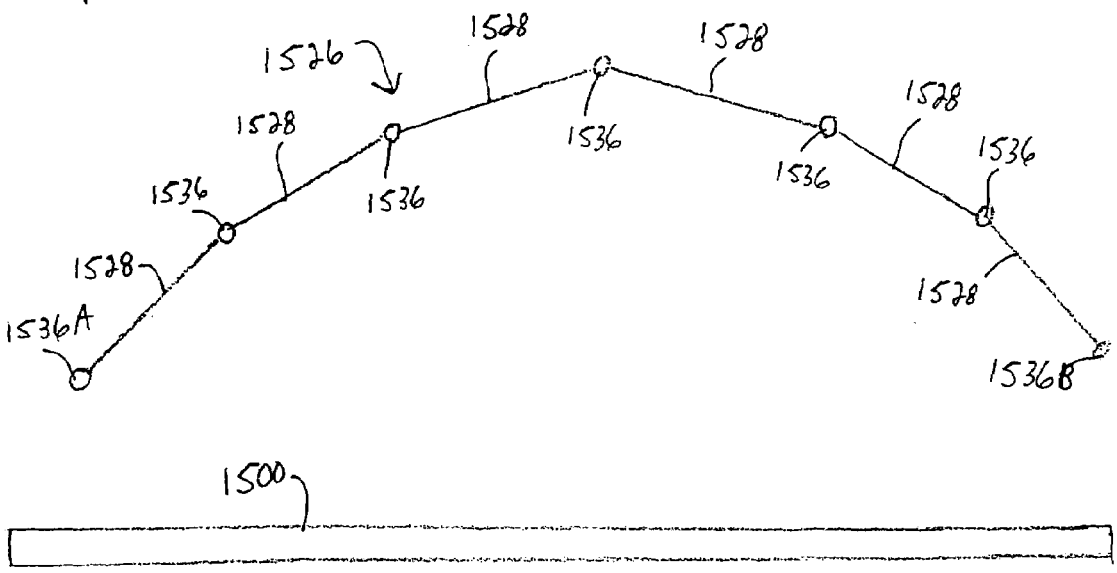
FIG. 23 shows a one-piece protective guard secured over a fence having a plurality of distinct fence sections, in accordance with other preferred embodiments of the present invention.

Referring to FIG. 23, in certain preferred embodiments, a fence 1526 includes a plurality of vertical posts 1536 and top support bars 1528 extending between the vertical posts 1536. An extruded protective guard 1500 is formed as one piece and has a length which substantially matches the length of the fence between a first vertical post 1536*a* and a final vertical post 1536*b*. In other words, the length of the protective guard has been designed to approximately equal the perimeter distance of the fence 1526 so that one continuous piece of material may cover the top of the fence.

Figure 24:
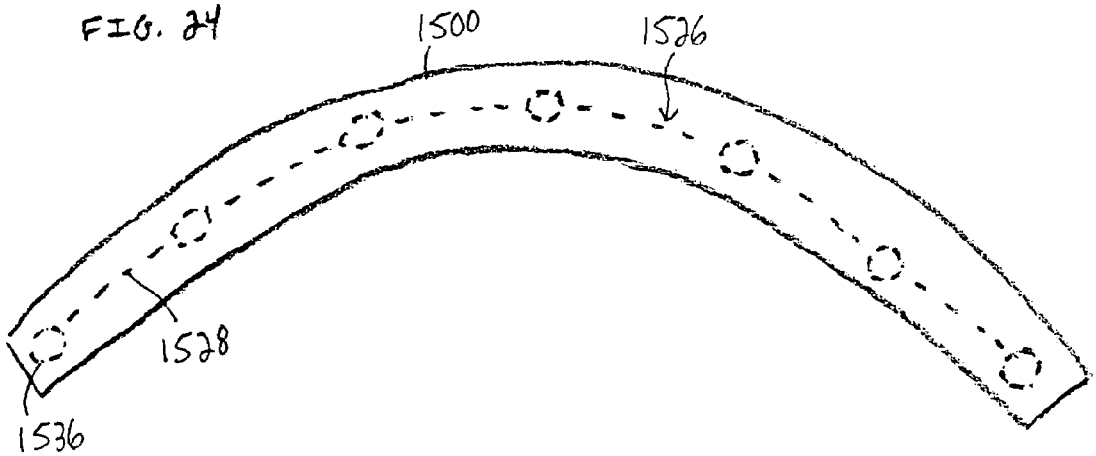
FIG. 24 shows the one-piece protective guard of FIG. 23 assembled atop the fence having a plurality of distinct fence sections of FIG. 23.

Referring to FIG. 24, protective guard 1500 is positioned atop the fence to cover the upper ends of the vertical posts 1536 and the top support bars 1528. Due to the fact that the protective guard 1500 is made of a polymer material such as polypropylene, the protective guard has sufficient flexibility to conform to the curvature of the fence 1526.

Figure 25:
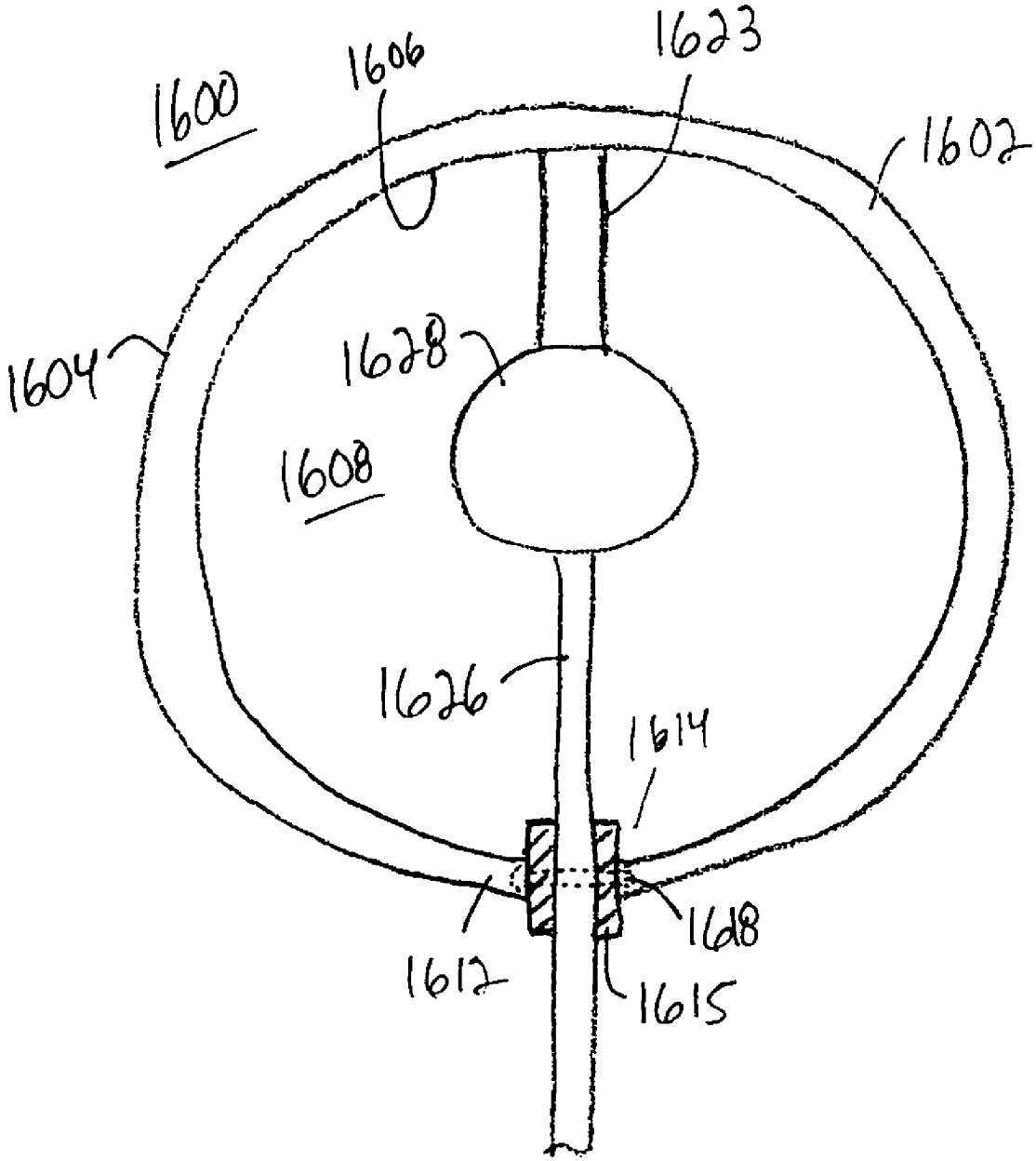
FIG. 25 shows a cross-sectional view of a protective guard for a fence, in accordance with still further preferred embodiments of the present invention.

Referring to FIG. 25, in certain preferred embodiments, the protective guard 1600 does not have attachment flanges projecting from an exterior surface 1604 of a tubular member. The protective guard 1600 includes tubular member 1602 having a slot 1614 extending along the length thereof at a lower end 1612 of tubular member 1602. The fence 1626 is passed through the slot 1614 so that an upper end of the fence and top support rail 1628 are positioned within interior space 1608 of protective guard 1600. The protective guard 1600 includes an insulating element 1615 which seals the slot 1614. A securing element 1618 effectively clamps the two halves of the tubular member 1602 together. As the securing element 1618 brings the two halves of the tubular member 1602 together, the insulating material and a portion of the fence are compressed therebetween. The insulating material 1615 provides an effective seal which prevents insects or birds from entering the interior space 1608 of the tubular member. The protective guard 1600 also includes a spacer element 1623 that contacts interior surface 1606 to prevent sagging of an intermediate region of the protective guard 1600. In other preferred embodiments, securing straps (not shown) may be placed around the exterior surface 1604 of the tubular member 1602 to hold the two halves of the protective guard together.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A combination including a fence and a protective guard comprising:

said fence having vertical posts with upper ends and at least one top support bar extending between said vertical posts;

a tubular member having first and second ends, an outer surface extending between the first and second ends, an inner surface extending between the first and second ends that defines an interior space, and a slot extending between the inner and outer surfaces and the first and second ends of said tubular member, wherein said tubular member is secured over an upper edge of said fence so that the upper ends of said vertical posts and said at least one top support bar are captured within the interior space of said tubular member;

a spacer positioned between the inner surface of said tubular member and said at least one top support bar for supporting said tubular member between said vertical posts, wherein said spacer is in contact with said tubular member and said top support bar for preventing sagging of said tubular member between said vertical posts; and insulation material disposed in the slot and the interior space of said tubular member for sealing the interior space of said tubular member.

2. The combination as claimed in claim 1, wherein said spacer has a height and wherein the upper ends of said vertical posts extend above said at least one top support bar by a vertical distance that is substantially equal to the height of said spacer.

3. The combination as claimed in claim 1, wherein said spacer has an upper end in contact with the inner surface of said tubular member and a lower end in contact with said at least one top support bar.

4. The combination as claimed in claim 1, wherein said tubular member is made of polypropylene.

5. The combination as claimed in claim 1, wherein said insulation material includes caps positioned within openings at the first and second ends of said tubular member.

6. The combination as claimed in claim 5, wherein said caps include a polymer material.

7. The combination as claimed in claim 1, wherein said insulation material includes at least one resilient strip positioned within the slot.

8. The combination as claimed in claim 1, further comprising first and second attachment flanges extending from the outer surface of said tubular member on opposite sides of the slot, wherein said attachment flanges are positioned on opposite sides of said fence when said protective guard is secured over said fence.

9. The combination as claimed in claim 8, further comprising at least one securing element in contact with said attachment flanges for securing said attachment flanges together on opposite sides of said fence.

10. A combination including a fence and a protective guard comprising:

said fence having vertical posts with upper ends and at least one top support bar extending between said vertical posts;

a tubular member having first and second ends, an outer surface extending between the first and second ends, an inner surface extending between the first and second ends that defines an interior space, and a slot extending between the inner and outer surfaces and the first and second ends of said tubular member, wherein said tubular member is secured over an upper edge of said fence so that the upper ends of said vertical posts and said at least one top support bar are captured within the interior space of said tubular member;

a spacer positioned between the inner surface of said tubular member and said at least one top support bar for supporting said tubular member between said vertical posts; and insulation material disposed in the slot and the interior space of said tubular member for sealing the interior space of said tubular member, wherein the first end of said tubular member has a reduced diameter that is adapted to slide within an opening at an end of an adjacent protective guard.

11. The combination as claimed in claim 10, further comprising first and second attachment flanges extending from the outer surface of said tubular member on opposite sides of the slot, wherein said attachment flanges are positioned on opposite sides of said fence when said protective guard is secured over said fence.

12. The combination as claimed in claim 11, further comprising at least one securing element in contact with said attachment flanges for securing said attachment flanges together on opposite sides of said fence.

13. A combination including a fence and a protective guard comprising:

said fence having vertical posts with upper ends and at least one top support bar extending between said vertical posts;

a tubular member having first and second ends, an outer surface extending between the first and second ends, an inner surface defining an interior space and a slot extending between the inner and outer surfaces and the first and second ends of said tubular member, wherein said tubular member is secured over an upper edge of said fence so that the upper ends of said vertical posts and the at least one top support bar are captured within the interior space of said tubular member; and a spacer positioned within the interior space of said tubular member and in contact with both the inner surface of said tubular member and said at least one top support bar for supporting said tubular member between said vertical posts so as to prevent said tubular member from sagging between said vertical posts, wherein said spacer extends only part way between the first and second ends of said tubular member.

14. The combination as claimed in claim 13, further comprising first and second attachment flanges extending from the outer surface of said tubular member on opposite sides of the slot, wherein said attachment flanges are positioned on opposite sides of said fence when said protective guard is secured over said fence.

15. The combination as claimed in claim 14, further comprising at least one securing element in contact with said attachment flanges for securing said attachment flanges together with a portion of said fence positioned between said attachment flanges.

* * * * *

UNITED STATES PATENT AND TRADEMARK OFFICE

CERTIFICATE OF CORRECTION

PATENT NO. : 7,118,096 B2
APPLICATION NO. : 10/816706
DATED : October 10, 2006
INVENTOR(S) : Louis J. Petrozziello It is certified that error appears in the above-identified patent and that said Letters Patent is hereby corrected as shown below:

**Column 1, delete lines 10 thru 18.

Column 1, delete lines 50 thru 57.

Column 1, line 50, please insert --The above-reference U.S. Patent Application Publication No. 2004/0012006 discloses a protective guard securable atop a fence to protect individuals from contacting the sharp edges of the fence. The protective guard has a rounded tubular member that defines an interior space that is designed to surround and capture the upper ends of vertical posts, the top support bars extending between the vertical posts and the upper edge of the wire mesh or chain link secured to the top support bars and the vertical posts.--**

Signed and Sealed this

Tenth Day of July, 2007

JON W. DUDAS
*Director of the United States Patent and Trademark Office*